United States Patent [19]

Knight et al.

[11] 4,078,745

[45] Mar. 14, 1978

[54] ROTARY KITE

[76] Inventors: Carl Edward Knight; JoAnn Frank Knight, both of 2550 28th Ave., San Francisco, Calif. 94116

[21] Appl. No.: 831,546

[22] Filed: Sep. 8, 1977

Related U.S. Application Data

[63] Continuation of Ser. No. 735,843, Oct. 26, 1976, abandoned.

[51] Int. Cl.[2] ..... B64C 31/06

[52] U.S. Cl. ..... 244/153 A; D34/15 AF; 244/155 A

[58] Field of Search ..... 244/153 R, 153 A, 154, 244/155 R, 155 A; 46/53; D34/15 AF

[56] References Cited

U.S. PATENT DOCUMENTS

| | | | |
|---|---|---|---|
| 1,744,529 | 1/1930 | De Haven | 244/155 R |
| 1,908,325 | 5/1933 | De Haven | 244/153 R |
| 2,835,462 | 5/1958 | Martin | 244/153 A |
| 3,954,236 | 5/1976 | Brown | 244/155 R |

*Primary Examiner*—Trygve M. Blix
*Assistant Examiner*—Charles E. Frankfort
*Attorney, Agent, or Firm*—Robert Charles Hill

[57] ABSTRACT

A rotary kite suitable for rotation in a direction perpendicular to the wind flow is provided with a symmetrical wind receiving surface supported by a frame and open at the ends thereof permitting the passage of air currents therethrough with at least one vane attached to one end of the frame and extending beyond therefrom into the wind flow to cause rotation.

6 Claims, 5 Drawing Figures

ROTARY KITE

This is a continuation of application Ser. No. 735,843 filed Oct. 26, 1976 and now abandoned.

SUMMARY OF THE INVENTION

A rotary kite rotates in a direction perpendicular to the wind flow about an axis parallel to the wind flow. Air currents pass through the two open ends of the kite surface and strike vane means attached to one end of the frame thereby producing rotation.

BACKGROUND OF THE INVENTION

Kite flying continues to have widespread acceptance as an enjoyable form of recreation. Kite flyers range in age from the young to the elderly and kites continue to be produced in a myriad of sizes, shapes and colors. Curiously enough, there is no known commercially available kite suirable for rotation in a direction perpendicular to the wind flow.

Careful analysis of the problems encountered with the existing prior art rotary kites led to the conclusion that the ideal rotary kite should rotate in a direction perpendicular to the wind flow, have line means inwardly of the frame, have a stable configuration, and provide vanes extending beyond the frame and into the wind flow. Unfortunately, as will be seen below, none of the prior art devices possesses all of these desired attributes.

U.S. Pat. No. 2,501,442 is representative of a number of devices which rotate with the wind flow, instead of perpendicular thereto, and discloses a closed airfoil kite containinng a rotating airfoil that rotates with respect to a central shaft which is supported at the ends of threads or strings, the opposite ends of the strings being controlled from the ground by the user of the device. U.S. Pat. Nos. 2,494,430, 2,768,803, 3,079,115 and 3,087,698 also relate to similar structures.

U.S. Pat. No. 2,835,462 shows a knockdown rotary kite. While this kite rotates in a direction perpendicular to the wind flow, it creates considerable air turbulence and a resultant wobble because the vanes are within the hollow kite body. Additionally, the length of the kite is too short in proportion to its width, so front and rear stabilizers are required for proper flying of the device.

The present invention eliminates all of the problems inherent in the above described devices. The present invention rotates in a direction perpendicular to the wind flow, has line means inwardly of the frame thereby creating a lifting lip, has a stable configuration with the frame length approximately twice the width, and eliminates excessive air turbulence within the kite surface by providing vanes extending beyond the frame and into the wind flow.

OBJECTS OF THE INVENTION

It is the primary object of the present invention to provide a new and improved rotary kite.

Another object is to provide a rotary kite which rotates in a direction perpendicular to the wind flow.

A further object is to provide structure which is inexpensive to manufacture and long lasting in usage.

DESCRIPTION OF THE PREFERRED EMBODIMENT

Figure 1:
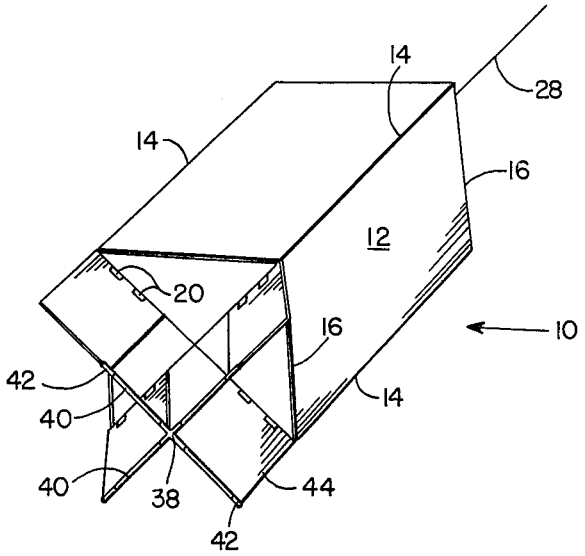
FIG. 1 is a perspective, elevational view of the rotary kite of the present invention in flying position.
Figure 2:
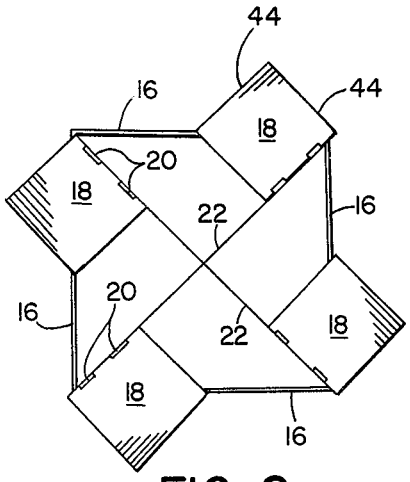
FIG. 2 is a rear view of the rotary kite with the vanes resting on the back frame of the kite.
Figure 3:
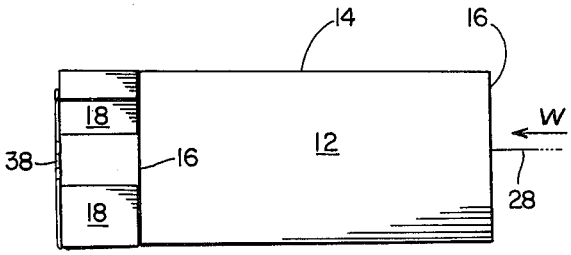
FIG. 3 is a side view of the rotary kite of FIG. 1.

Referring to FIGS. 1 through 3 which illustrate the rotary kite of the present invention, the rotary kite generally indicated 10 has a wind receiving surface 12 symmetrical about a central axis and open at the ends thereof to permit the passage of air currents therethrough and supported by longitudinal frame means 14 and end frame means 16. The wind receiving surface can be of any well-known substance such as paper, plastic, cloth, etc. The frame means 14 and 16 can be of any strong lightweight material such as wood, plastic, aluminum, etc. While the ends of the rotary kite shown in FIGS. 1 through 3 are square, it should be understood that the wind receiving surface could be of any symmetrical shape such as circular, for example.

Figure 5:
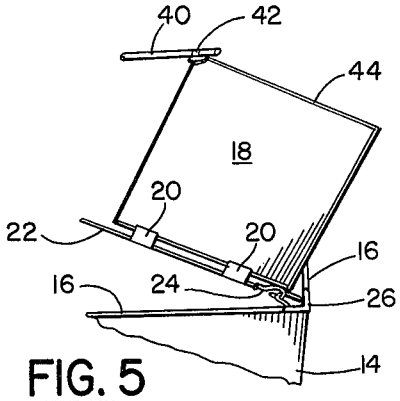
FIG. 5 is an enlarged view illustrating the connection of a vane to the frame.

Attached to one end of the frame means 16 and extending beyond therefrom are a plurality of vanes 18. These vanes 18 are secured by a suitable adhesive 20 or the like to intersecting cords 22 which, as shown in FIG. 5, terminate at each end in hooks 24 which cooperate with clips 26 located in the corners of the frame means 16. Thus the vanes 18 are readily removable and/or replaceable as desired. The cords 22 intersect at approximately a 90° angle and two vanes 18 are attached to each cord 22. Of course, a greater or lesser number of vanes 18 could be attached to each cord 22 depending upon a number of factors such as vane size, cord length, etc. While the vanes 18 are shown as square in shape, they could have other shapes if desired. The vanes 18 can be of the same material as the wind receiving surface 12 or they may be of some other paper, plastic or cloth substance.

Figure 4:
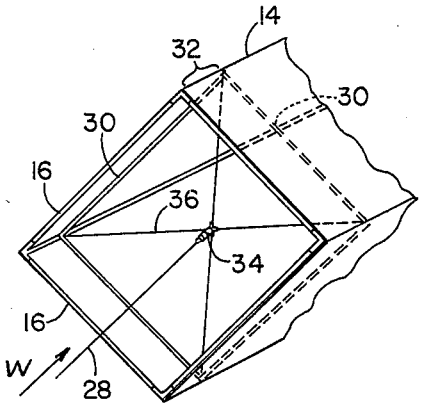
FIG. 4 is a perspective view of the front portion of the rotary kite illustrating the connection of the line means inwardly of the frame.

Line means 28 is connected near the other end of longitudinal frame means 14 for maintaining control of the kite 10 during rotative flight. As shown in FIGS. 4, interior frame 30 is positioned inwardly a distance equal to approximately 10 to 15% of the length of frame means 14. This inward connection creates a lifting lip shown by the distance 32 which together with the weight of the vanes 18 creates an angle pitch relative to the direction of wind flow shown by arrow W to greater enhance the lift characteristics of the kite. If the open ends of the kite are perpendicular to the wind flow as shown in FIG. 3, then there is no lift and the structure of the present invention prevents this from happening. Line 28 connects to the front portion of swivel member 34 while the rear portion of swivel member 34 fastens onto intersecting cords 36 which in turn stretch between opposite corners of interior frame 30. Thus swivel member 34 allows line 28 to be stationary while kite 10 rotates.

The kite 10 is rotated when the air passing through the kite strikes the vanes 18. For best results, the vanes 18 should maintain a relatively fixed angle during flight. This can be accomplished by means of the "X" member 38 shown in FIG. 1 which has extensions 40 sliding into channels 42 secured to peripheral members 44 of the vanes 18. A vane angle of about 45° produces the greatest rotational speed during flight. Another method of fixing the vane angle would be to have members extending from each corner of frame means 16 to vane means 18. The use of member 38 allows the vane angles to be changed from one 45° setting to another 45° setting thereby reversing the direction of rotation of the kite 10. Naturally, air turbulence is created when the air strikes the vanes 18 but this does not result in flight difficulties since the vanes 18 extend beyond the wind receiving surface 12.

The ratio of the length of longitudinal frame means 14 to end frame 16 has some effect on the flight characteristics of the kite 10. A very stable flight configuration utilizes a longitudinal frame which is approximately twice the length of the end frame 16.

It will be obvious that numerous modifications and variations are possible for the above described rotary kite within the scope of the present invention. The foregoing description, as setting forth various constructional and operational details for purposes of understanding only, is not to be taken as limiting the scope of the present invention which is defined only by the following claims.

I claim:

1. A rotary kite suitable for rotation in a direction perpendicular to the wind flow comprising, a symmetrical wind receiving surface open at the ends thereof to permit the passage of air currents therethrough, frame means at each end of said wind receiving surface, longitudinal frame support means connecting said end frame means, internal frame means for said surface located inwardly a distance equal to approximately 10 to 15% of the length of said longitudinal frame support means, vane means attached to one end frame means and extending beyond therefrom, and line means connected to said internal frame means for maintaining control of the kite during rotative flight.

2. The rotary kite of claim 1 wherein means on the vane means determines the vane angle during flight.

3. The rotary kite of claim 10 wherein the length of the longitudinal frame support means is approximately twice the width of the open ends.

4. The rotary kite of claim 2 wherein the vane angles can be changed to reverse the direction of rotation.

5. The rotary kite of claim 2 wherein the means on the vane means positions the vanes at about 45° during flight.

6. The rotary kite of claim 5 wherein the vanes are square in shape.

* * * * *